US008753095B2

(12) United States Patent
Bruce

(10) Patent No.: US 8,753,095 B2
(45) Date of Patent: Jun. 17, 2014

(54) PUMPING SYSTEM AND METHOD OF OPERATION

(75) Inventor: Simon Harold Bruce, East Grinstead (GB)

(73) Assignee: Edwards Limited (GB)

( * ) Notice: Subject to any disclaimer, the term of this patent is extended or adjusted under 35 U.S.C. 154(b) by 361 days.

(21) Appl. No.: 11/919,535

(22) PCT Filed: Apr. 13, 2006

(86) PCT No.: PCT/GB2006/001347

§ 371 (c)(1),
(2), (4) Date: Oct. 29, 2007

(87) PCT Pub. No.: WO2006/117503

PCT Pub. Date: Nov. 9, 2006

(65) Prior Publication Data

US 2009/0317261 A1 Dec. 24, 2009

(30) Foreign Application Priority Data

Apr. 29, 2005 (GB) ..... 0508872.9

(51) Int. Cl.

| | |
|---|---|
| ***F04D 15/02*** | (2006.01) |
| ***F04D 27/00*** | (2006.01) |
| ***F04D 19/04*** | (2006.01) |
| ***F04D 15/00*** | (2006.01) |

(52) U.S. Cl.

CPC ..... *F04D 19/042* (2013.01); *F04D 15/0077* (2013.01); *F04D 15/0263* (2013.01)

USPC ..... 417/32; 417/423.4

(58) Field of Classification Search

CPC F04D 15/0077; F04D 15/0263; F04D 19/042

USPC ..... 417/32, 44.1, 423.4

See application file for complete search history.

(56) References Cited

U.S. PATENT DOCUMENTS

| | | | |
|---|---|---|---|
| 5,618,167 | A | 4/1997 | Hirakawa et al. |
| 5,624,239 | A | 4/1997 | Osika |

(Continued)

FOREIGN PATENT DOCUMENTS

| | | | |
|---|---|---|---|
| DE | 101 13 251 | A1 | 10/2002 |
| EP | 0574623 | A1 | 12/1993 |

(Continued)

OTHER PUBLICATIONS

Kawagishi Kenji; abstract and pp. 540-542 of JP 63-283492, entitled "Motor Controller for Compressor," Mitsubishi Electric Corp; Nov. 21, 1988.

(Continued)

*Primary Examiner* — Bryan Lettman

(74) *Attorney, Agent, or Firm* — Shumaker & Sieffert, P.A.

(57) ABSTRACT

A pumping system includes a pumping mechanism, a motor for driving the pumping mechanism, a device for supplying power of a variable frequency to the motor, a control device for setting a maximum value for a current in the motor, and a device for supplying to the control device data indicative of the temperature of gas exhaust from the pumping mechanism and a temperature of the stator of the pumping mechanism, wherein the control device is configured to use the received data to adjust the maximum value during operation of the pumping system.

19 Claims, 5 Drawing Sheets

(56) References Cited

U.S. PATENT DOCUMENTS

| | | | | |
|---|---|---|---|---|
| 5,655,839 | A | 8/1997 | Schmidt et al. | |
| 5,746,581 | A | 5/1998 | Okumura et al. | |
| 5,879,139 | A | 3/1999 | Hayashi et al. | |
| 5,944,049 | A | 8/1999 | Beyer et al. | |
| 6,056,510 | A | 5/2000 | Miura et al. | |
| 6,123,522 | A | 9/2000 | Kubo et al. | |
| 6,178,659 | B1 | 1/2001 | Corner | |
| 6,244,825 | B1 | 6/2001 | Sasaki et al. | |
| 6,257,001 | B1 | 7/2001 | Muldowney et al. | |
| 6,416,290 | B1 * | 7/2002 | Yamauchi | 417/32 |
| 6,629,824 | B2 | 10/2003 | Yamauchi | |
| 6,695,589 | B1 | 2/2004 | Dougan et al. | |
| 6,739,840 | B2 | 5/2004 | Curry et al. | |
| 6,851,848 | B2 | 2/2005 | Miwata et al. | |
| 6,910,850 | B2 | 6/2005 | Nonaka et al. | |
| 6,966,967 | B2 | 11/2005 | Curry et al. | |
| 7,143,016 | B1 * | 11/2006 | Discenzo et al. | 703/3 |
| 7,564,670 | B2 | 7/2009 | Kozaki et al. | |
| 2003/0219342 | A1 | 11/2003 | Curry et al. | |
| 2004/0064212 | A1 | 4/2004 | Samata et al. | |
| 2004/0081560 | A1 | 4/2004 | Blumenthal et al. | |
| 2005/0031468 | A1 | 2/2005 | Kawaguchi et al. | |
| 2005/0249618 | A1 | 11/2005 | Nonaka et al. | |
| 2007/0104587 | A1 * | 5/2007 | Kawamura et al. | 417/32 |
| 2007/0172376 | A1 | 7/2007 | Ohmi | |
| 2009/0317261 | A1 | 12/2009 | Bruce | |
| 2010/0047080 | A1 | 2/2010 | Bruce | |

FOREIGN PATENT DOCUMENTS

| | | | | |
|---|---|---|---|---|
| EP | 0644333 | A2 | 3/1995 | |
| EP | 1482178 | A1 | 1/2004 | |
| JP | 58-63088 | A | 4/1983 | |
| JP | 64019198 | U | 1/1989 | |
| JP | 11132186 | A | 5/1995 | |
| JP | 10266991 | A | 10/1998 | |
| JP | 11037087 | A | 2/1999 | |
| JP | 2004116319 | A | 4/2004 | |
| JP | 2004-190583 | A | 7/2004 | |
| WO | WO2004-036049 | * | 4/2004 | F04C 29/04 |
| WO | WO 2005/038255 | A2 | 4/2005 | |

OTHER PUBLICATIONS

United Kingdom Search Report of Application No. GB 0508872.9; Date of mailing: Aug. 22, 2005; Claims searched: 1-21; Date of search: Aug. 19, 2005.

PCT Notification of Transmittal of the International Search Report and the Written Opinion of the International Searching Authority, or the Declaration of International Application No. PCT/GB2006/001347; Date of mailing: Jul. 25, 2006.

PCT International Search Report of International Application No. PCT/GB2006/001347; Date of mailing of the International Search Report: Jul. 25, 2006.

PCT Written Opinion of the International Searching Authority of International Application No. PCT/GB2006/001347; Date of mailing: Jul. 25, 2006.

Translation of First Office Action dated Feb. 20, 2009 from the State Intellectual Property Office, P.R. China in corresponding CN Application No. 200680014635.0, 7 pgs.

Translation of amended claims as filed in response to First Office Action dated Feb. 20, 2009 from the State Intellectual Property Office, P.R. China in corresponding CN Application No. 200680014635.0, 3 pgs.

Preliminary Amendment filed Aug. 1, 2007 in U.S. Appl. No. 11/883,616, 16 pgs.

Office Action mailed Jan. 11, 2013 in U.S. Appl. No. 11/883,616, 15 pgs.

Amendment and Response filed Jun. 11, 2013 in U.S. Appl. No. 11/883,616, 16 pgs.

Office Action dated Oct. 28, 2013 in U.S. Appl. No. 11/883,616, 20 pgs.

Response filed Jan. 28, 2014 to the Office Action dated Oct. 28, 2013 in U.S. Appl. No. 11/883,616, 19 pgs.

* cited by examiner

PUMPING SYSTEM AND METHOD OF OPERATION

The present invention relates to a method of operating a pumping system.

Vacuum processing is commonly used in the manufacture of semiconductor devices and flat panel displays to deposit thin films on to substrates, and in metallurgical processes. Pumping systems used to evacuate relatively large process chambers, such as load lock chambers, to the desired pressure generally comprise at least one booster pump connected in series with at least one backing pump.

Booster pumps typically have oil-free pumping mechanisms, as any lubricants present in the pumping mechanism could cause contamination of the clean environment in which the vacuum processing is performed. Such "dry" vacuum pumps are commonly single or multi-stage positive displacement pumps having a pumping mechanism employing intermeshing rotors located within a stator. The rotors may have the same type of profile in each stage or the profile may change from stage to stage. The backing pumps may have either a similar pumping mechanism to the booster pumps, or a different pumping mechanism.

An asynchronous AC motor typically drives the pumping mechanism of a booster pump. Such motors must have a rating such that the pump is able to supply adequate compression of the pumped gas between the pump inlet and outlet, and such that the pumping speed resulting is sufficient for the duty required.

A proportion of the power supplied to the motor of the booster pump produces heat of compression in the exhaust gas, particularly at intermediate and high inlet pressure levels, such that the pump body and rotors can heat up. If the amount of compression and differential pressure generated is not adequately controlled, there may be a risk of overheating the booster pump, ultimately resulting in lubrication failure, excessive thermal expansion and seizure.

The standard motor for the size and pumping speed of the booster pump is thus usually selected such that it should be able to supply adequate compression in normal use at low inlet pressures but a risk of overheating remains if the pump is operated at intermediate and high inlet pressure levels without a means of protection. For driving the motor, a variable frequency drive unit may be provided between the motor and a power source for the motor. Such drive units operate by converting the AC power supplied by the power source into an AC power of desired amplitude and frequency. The power supplied to the motor is controlled by controlling the current supplied to the motor, which in turn is controlled by adjusting the frequency and/or amplitude of the voltage in the motor. The current supplied to the motor determines the amount of torque produced in the motor, and thus determines the torque available to rotate the pumping mechanism. The frequency of the power determines the speed of rotation of the pumping mechanism. By varying the frequency of the power, the booster pump can maintain a constant system pressure even under conditions where the gas load may vary substantially.

In order to prevent overloading of the booster pump, the drive unit sets a maximum value for the frequency of the power ($f_{max}$), and a maximum value for the current supplied to the motor ($I_{max}$). This current limit will conventionally be appropriate to the continuous rating of the motor, and will limit the effective torque produced by the pumping mechanism and hence the amount of differential pressure resulting, thereby limiting the amount of exhaust gas heat generated.

However, if the above control is not ideal and the booster pump operates under conditions with excessive gas heat, the pumping mechanism of the booster pump will begin to overheat, causing the rotors of the pumping mechanism to expand in a uniform manner as their temperature increases. However, the stator of the pumping mechanism will expand in a non-uniform manner. Typically the hot exhaust gas causes a strong heating effect on the exhaust side of the pump, while the continued input of cold gas at the inlet causes no such heating. As a consequence, the exhaust side of the stator heats up and expands, such that there is little loss of running clearances between the hot rotors and hot stator in this region of the pump. However, there is comparatively very little heating and expansion of the stator on the inlet side of the pump, and if rotor expansion is allowed to continue, running clearances between rotor and stator are typically lost and contact occurs, typically in a specific narrow region around the colder inlet throat of the stator. In view of this, relatively complex and expensive heat exchangers or other cooling mechanisms are often employed to reduce the risk of such clashing between rotor and stator of the pumping mechanism.

It is an aim of at least the preferred embodiment of the present invention to seek to provide a relatively simple and low cost method of operating a vacuum pump to reduce the risk of clashing between a rotor and a stator of the pumping mechanism of the vacuum pump.

In a first aspect, the present invention provides a pumping system comprising a pumping mechanism; a motor for driving the pumping mechanism; means for supplying power of a variable frequency to the motor; control means for setting maximum values for a current and frequency in the motor; and means for supplying to the control means data indicative of the temperature of gas exhaust from the pumping mechanism and a temperature of the stator of the pumping mechanism, wherein the control means is configured to use the received data to adjust at least one of said maximum values during operation of the pumping system.

By monitoring these temperatures, an indication of the clearance between a rotor and a stator of the pumping mechanism can be obtained by the control means. From this, the control means can predict the onset of contact between the rotor and the stator due to over-heating of the rotor. In order to prevent clashing between the rotor and the stator, the control means can automatically reduce the maximum value for a current in the motor. With such a reduction of the maximum current value, the variable frequency drive means automatically reduces the frequency of the power supplied to the motor, which has the effect of slowing the rotation speed of the rotor and thus reducing the differential pressure across the pumping mechanism. As the differential pressure reduces, so does the heat of compression generated in the gas exhaust from the pumping mechanism, and this in turn will reduce the temperature of the rotor, thereby reducing the risk of clashing between the rotor and the stator. This can provide greater operational reliability, especially in larger, complex booster pumps, and can enable the pumping system to be used at the highest practical efficiency with minimal, or no, thermal safety risks without the use of expensive heat exchangers or other cooling mechanisms to deal with potential thermal excursions.

As the temperature of the rotor will be dependent, to a first order, on exhaust gas temperature and elapsed operating time, the temperature of the rotor can be monitored using a signal output from a first temperature sensor arranged to monitor the temperature of gas exhaust from the pumping mechanism. The data contained in this signal can be integrated over time so that the actual rotor temperature can be determined. This determination can be further enhanced by the additional use of a booster inlet pressure measurement. A second temperature sensor can be provided for supplying a signal indicative of the temperature of a chosen part of the stator. A suitable computational logic can then be applied to these temperatures to provide an accurate estimate of the running clearance between the rotor and the chosen part of the stator.

As an alternative to using the received signals to provide an indication of the clearance between the rotor and the stator of the pumping mechanism, and/or of the temperature of the rotor, the magnitudes of the signals themselves may be used by the control means to adjust the maximum value for the current in the motor.

As contact is more likely to occur where there is the greatest temperature differential between the rotor and the stator, at least one, optionally two or more, second temperature sensors are preferably located proximate an inlet throat of the pumping mechanism. These second temperature sensors may be conveniently located on the external surface of the stator of the pumping mechanism, which can enable the position of these sensors to be easily changed as required.

The estimated running clearance can be additionally modified by a measurement of the booster pump inlet pressure, which can be used to identify the inlet pressure region across which excess heat generation is most likely. This clearance estimation can be further enhanced by monitoring the stator temperature for any sudden increase, which would result from the first onset of clearance loss and frictional local heating at that point, hence detecting the start of rotor/stator contact. Alternatively, or additionally, an additional vibration sensor mounted externally on the stator can be used to detect the onset of actual rotor/stator contact.

In one embodiment, the control means is provided by a single controller that receives the signals output from the temperature sensors, and adjusts the maximum value for the current in the motor in response thereto. In another embodiment, the control means is provided by a first controller that receives the signals output from the temperature sensors, and outputs to a second controller a command signal instructing the second controller to adjust the maximum value for the current in the motor by an amount determined by the first controller using the received signals.

In a second aspect, the present invention provides a method of controlling a pumping system comprising a pumping mechanism, a motor for driving the pumping mechanism and a variable frequency drive unit for supplying power to the motor, the method comprising the steps of setting maximum values for a current and frequency in the motor, receiving data indicative of the temperature of gas exhaust from the pumping mechanism and a temperature of the stator of the pumping mechanism, and using the received data to adjust at least one of said maximum values during operation of the pumping system.

Features described above in relation to system aspects of the invention are equally applicable to method aspects of the invention, and vice versa.

Preferred features of the present invention will now be described with reference to the accompanying drawing, in which FIG. 1 illustrates schematically an example of a pumping system for evacuating an enclosure;

Figure 1:
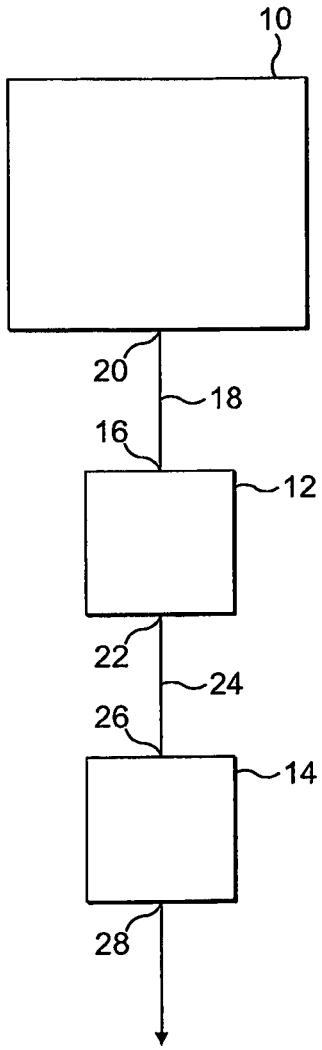

FIG. 1 illustrates a vacuum pumping system for evacuating an enclosure 10, such as a load lock chamber or other relatively large chamber. The system comprises a booster pump 12 connected in series with a backing pump 14. The booster pump 12 has an inlet 16 connected by an evacuation passage 18, preferably in the form of a conduit 18, to an outlet 20 of the enclosure 10. An exhaust 22 of the booster pump 12 is connected by a conduit 24 to an inlet 26 of the backing pump 14. The backing pump 14 has an exhaust 28 that exhausts the gas drawn from the enclosure 10 to the atmosphere.

Whilst the illustrated pumping system includes a single booster pump and a single backing pump, any number of booster pumps may be provided depending on the pumping requirements of the enclosure. Where a plurality of booster pumps are provided, these are connected in parallel so that each booster pump can be exposed to the same operating conditions. Where a relatively high number of booster pumps are provided, two or more backing pumps may be provided in parallel. Furthermore, an additional row or rows of booster pumps similarly connected in parallel may be provided as required between the first row of booster pumps and the backing pumps.

Figure 2:
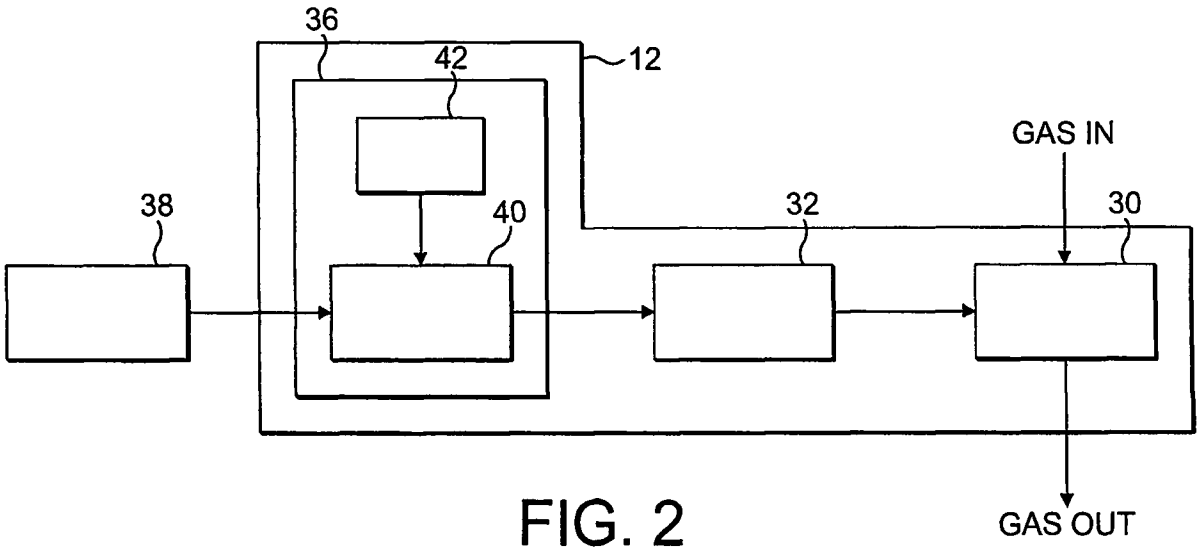
FIG. 2 illustrates schematically an example of a drive system for driving a motor of the booster pump of the pumping system of FIG. 1.

With reference to FIG. 2, the booster pump 12 comprises a pumping mechanism 30 driven by a variable speed motor 32. Booster pumps typically include an essentially dry (or oil free) pumping mechanism 30, but generally also include some components, such as bearings and transmission gears, for driving the pumping mechanism 30 that require lubrication in order to be effective. Examples of dry pumps include Roots, Northey (or "claw") and screw pumps. Dry, pumps incorporating Roots and/or Northey mechanisms are commonly multi-stage positive displacement pumps employing intermeshing rotors in each pumping chamber. The rotors are located on contra-rotating shafts, and may have the same type of profile in each chamber or the profile may change from chamber to chamber.

The backing pump 14 may have either a similar pumping mechanism to the booster pump 12, or a different pumping mechanism. For example, the backing pump 14 may be a rotary vane pump, a rotary piston pump, a Northey, or "claw", pump, or a screw pump.

The motor 32 of the booster pump 12 may be any suitable motor for driving the pumping mechanism 30 of the booster pump 12. In the preferred embodiment, the motor 32 comprises an asynchronous AC motor. A control system for driving the motor 32 comprises a variable frequency drive unit 36 for receiving an AC power supplied by a power source 38 and converting the received AC power into a power supply for the motor 32.

The drive unit 36 comprises an inverter 40 and an inverter controller 42. As is known, the inverter 40 comprises a rectifier circuit for converting the AC power from the power source 38 to a pulsating DC power, an intermediate DC circuit for filtering the pulsating DC power to a DC power, and an inverter circuit for converting the DC power into an AC power for driving the motor 32.

The inverter controller 42 controls the operation of the inverter 40 so that the power has a desired amplitude and frequency. The inverter controller 42 adjusts the amplitude and frequency of the power in dependence on an operational state of the pumping system. When the frequency of the power output from the inverter 40 varies, the speed of rotation of the motor 32 varies in accordance with the change in frequency. The drive unit 36 is thus able to vary the speed of the booster pump 12 during the evacuation of the enclosure 10 to optimise the performance of the booster pump 12.

The inverter controller 42 sets values for two or more operational limits of the drive unit 36; in particular, the maximum frequency of the power supplied to the motor 32 ($f_{max}$), and the maximum current that can be supplied to the motor 32 ($I_{max}$). As mentioned above, the value of $I_{max}$ is normally set so that it is appropriate to the continuous rating of the motor 32, that is, the power at which the motor can be operated indefinitely without reaching an overload condition. Setting a maximum to the power supplied to the motor has the effect of limiting the effective torque available to the pumping mechanism 30. This in turn will limit the resulting differential pressure across the booster pump 12, and thus limit the amount of heat generated within the booster pump 12.

The inverter controller 42 also monitors the current supplied to the motor 32. The current supplied to the motor 32 is dependent upon the values of the frequency and amplitude of the AC power supplied to the motor 32 by the drive unit 36. In the event that the current supplied to the motor 32 exceeds $I_{max}$, the inverter controller 42 controls the inverter 40 to reduce the frequency of the power supplied to the motor 32, thereby reducing both the current below $I_{max}$ and the speed of the booster pump 12.

As mentioned above, the inverter controller 42 pre-sets values for $I_{max}$ and $f_{max}$ that are appropriate to the continuous rating of the motor 32, that is, the power at which the motor can be operated indefinitely without reaching an overload condition. In order to prevent over-heating of the rotors of the pumping mechanism 30, which could lead to clashing between the rotors and the stator of the pumping mechanism 30, the inverter controller 42 is configured to adjust the value of $I_{max}$ during use of the pumping system 10. By reducing the value of $I_{max}$ during operation of the booster pump 12, the inverter 40 is caused to rapidly reduce the frequency of the power supplied to the motor 32. This in turn causes the rotation speed of the rotors to decrease, thus reducing the differential pressure across the pumping mechanism 30. As the differential pressure reduces, so does the heat of compression generated in the gas exhaust from the pumping mechanism 30, and this in turn will reduce the temperature of the rotors, thereby reducing the risk of clashing between the rotors and the stator. Depending on circumstances, it may also be appropriate to reduce $f_{max}$ in addition.

Figure 3:
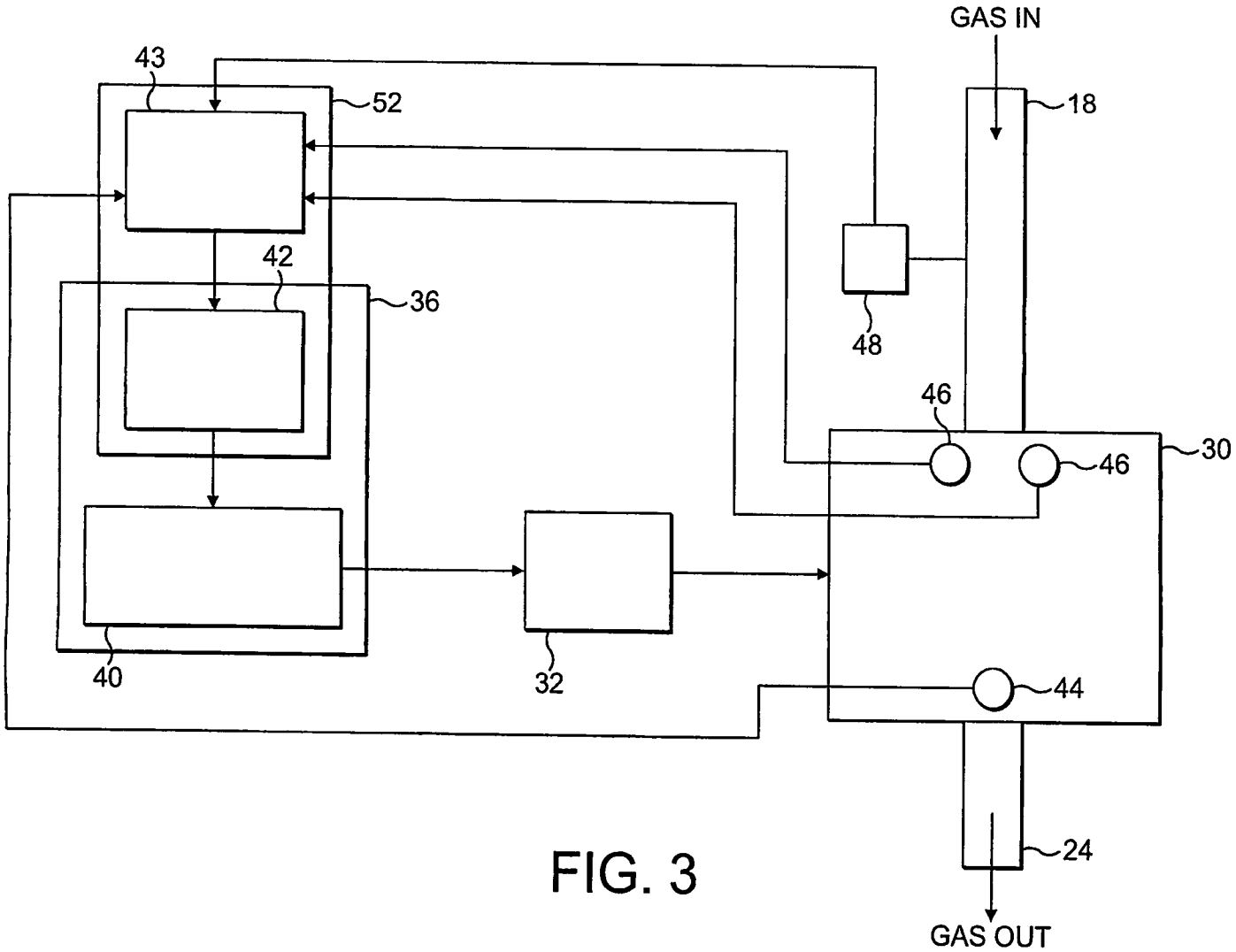
FIG. 3 illustrates a first example of an arrangement for monitoring and controlling various states of the pumping system of FIG. 1.

FIG. 3 illustrates a first example of an arrangement of sensors for monitoring one or more operational states of the pumping system 10 and providing signals indicative of the operational states to a controller 43 for use in adjusting the value of $I_{max}$. The arrangement comprises a first temperature sensor 44 for monitoring the temperature of gas exhaust from the pumping mechanism 30. In this arrangement, the sensor 44 is inserted horizontally through the exhaust flange of the booster pump 12 into the hot gas stream exhaust from the pump 12. The sensor 44 outputs a signal to the controller 43 indicative of the temperature of the exhaust gas. The received signal is integrated over time by the controller 43 to provide an indication of the temperature of the rotors of the pumping mechanism 32.

The arrangement further comprises at least one (two are shown in FIG. 3 although any suitable number may be provided) second temperature sensors 46 mounted on the external surface of the stator of the pumping mechanism 30. As contact between the rotors and the stator is most likely to occur in a region around the relatively cold inlet throat of the stator, the second temperature sensors 46 are mounted around this region to output to the controller 43 signals indicative of the temperature of the stator at this region.

Using the signals received from the first and second temperature sensors 44, 46, an accurate estimate of the current clearance between the rotors and the stator of the pumping mechanism 32 can be determined by the controller 43. Depending on the value of this clearance, the inverter controller 42 can be commanded by the controller 43 to reduce the value of $I_{max}$ during operation of the booster pump 12 to reduce the heating of the rotors of the pumping mechanism 30 and prevent clashing between the stator and the rotors. Furthermore, depending on the value of this clearance, the controller 43 may also command the inverter controller 42 to reduce the value of $f_{max}$ during operation of the booster pump 12 to reduce the heating of the rotors of the pumping mechanism 30 and prevent clashing between the stator and the rotors.

A measurement of the booster pump inlet pressure can be used to identify the inlet pressure region across which excess booster heat generation is most likely. In view of this, as shown in FIG. 3, the sensor arrangement may include a pressure sensor 48 arranged to monitor the gas pressure at the inlet of the pumping mechanism 30.

The estimate of the clearance can be further modified by monitoring the signals received from the second temperature sensors 46 for any sudden increase in temperature, which would result from the first onset of clearance loss and frictional local heating at the point of contact. Alternatively, as illustrated in FIG. 4, the sensor arrangement may be modified to include a vibration sensor 50 mounted on the external surface of the inlet throat of the stator to detect the onset of rotor/stator contact.

Figure 4:
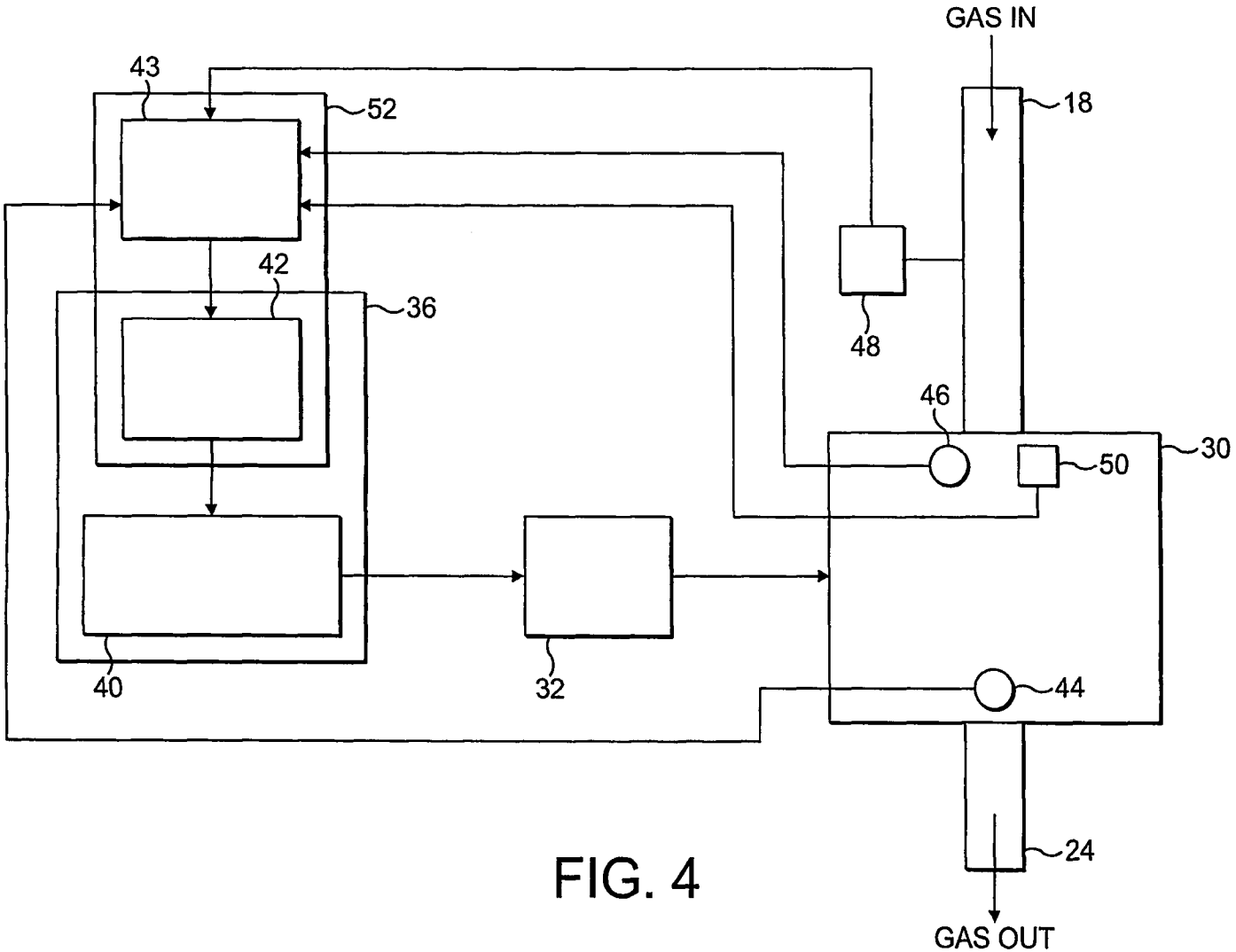
FIG. 4 illustrates a second example of an arrangement of sensors for monitoring various states of the pumping system of FIG. 1.
Figure 5:
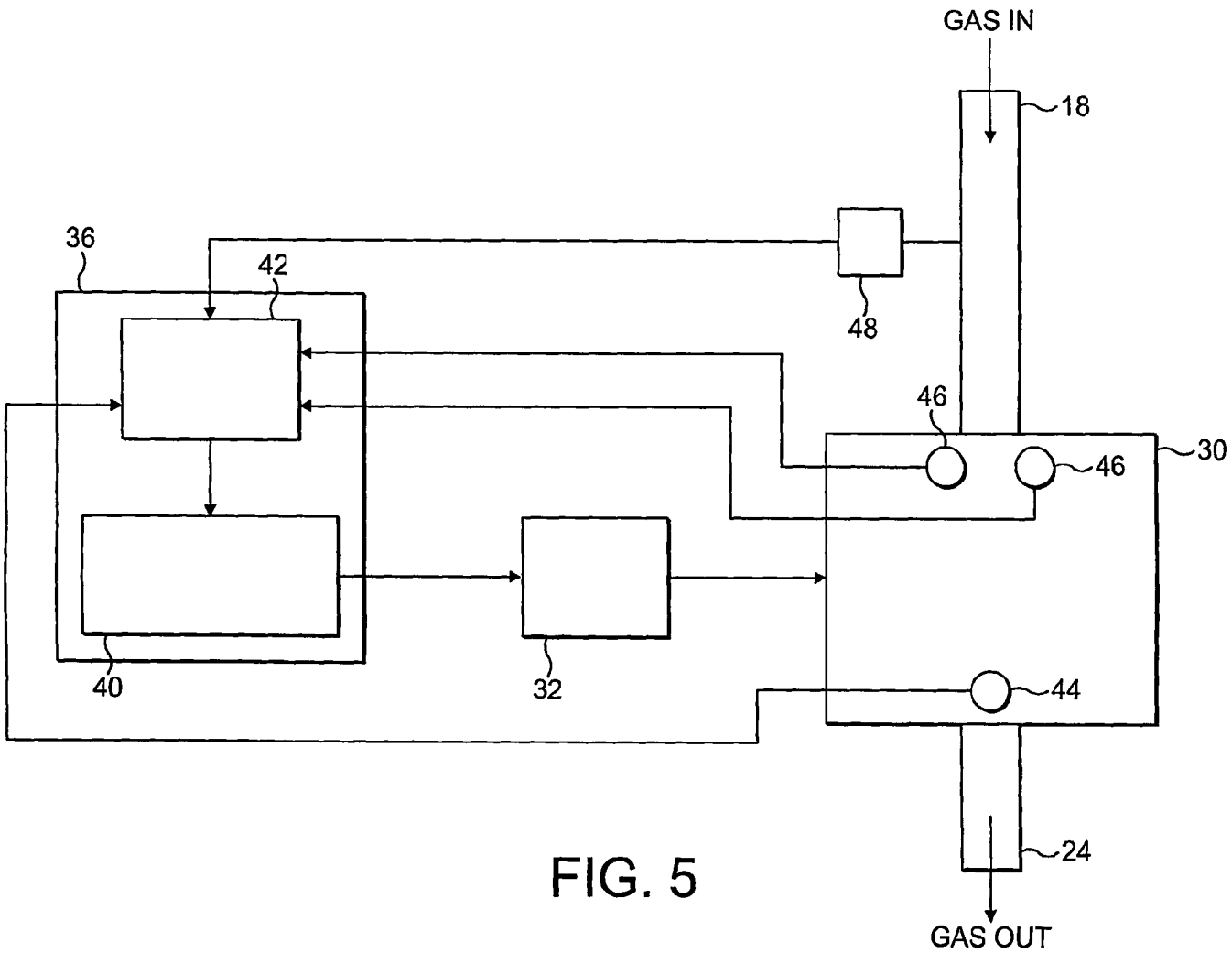
FIG. 5 illustrates a third example of an arrangement for monitoring and controlling various operational states of the pumping system of FIG. 1.

In the examples illustrated in FIGS. 3 and 4, the inverter controller 42 and the controller 43 together provide a control means 52 for setting maximum values for a current and frequency in the motor, receiving data indicative of the temperature of gas exhaust from the pumping mechanism and a temperature of the stator of the pumping mechanism, and using the received data to adjust at least one of the maximum values during operation of the pumping system. In the example illustrated in FIG. 5, the signals output from the sensors 44, 46, 48 are fed directly to the inverter controller 42, which adjusts at least one of the maximum values in dependence on the parameters monitored by these sensors. This can provide a simplified control means for adjusting these maximum values.

The invention claimed is:

1. A pumping system comprising:

a pumping mechanism;

a motor for driving the pumping mechanism;

a variable frequency drive that supplies electrical power to the motor;

a controller for controlling the motor via the variable frequency drive, wherein the controller sets a maximum value for a current in the motor and a maximum value for rotational frequency in the motor;

a first temperature sensor for supplying a first signal to the controller, the first signal indicative of a temperature of gas exhausted from an outlet of the pumping mechanism; and a second temperature sensor located on a stator adjacent to an inlet throat of the stator of the pumping mechanism for supplying a second signal to the controller, the second signal indicative of the temperature of the stator adjacent to the inlet throat of the stator of the pumping mechanism, wherein the controller adjusts at least one of the maximum value for current in the motor and the maximum value for rotational frequency in the motor based on a difference between the temperature of the gas exhausted at the outlet of the pumping mechanism, as indicated by the first signal, and the temperature of the stator adjacent to the inlet throat of the stator of the pumping mechanism, as indicated by the second signal, during operation of the pumping system.

2. The system according to claim 1, wherein the controller adjusts the amplitude and frequency of the power supplied to the motor by the drive means during operation of the pumping system.

3. The system according to claim 1, wherein the first temperature sensor is located proximate an exhaust of the pumping mechanism.

4. The system according to claim 1, wherein the controller adjusts at least one of the maximum values in dependence at least on the variation with time of the signal received from the first temperature sensor.

5. The system according to claim 1, wherein the controller adjusts at least one of the maximum values in dependence on at least the variation with time of the signal received from the second temperature sensor.

6. The system according to claim 1, further comprising a plurality of the second temperature sensors each located at different positions on an external surface of the stator of the pumping mechanism.

7. The system according to claim 1, further comprising a vibration sensor, wherein the vibration sensor supplies a signal indicative of vibration of the pumping mechanism, and wherein the controller uses the signal received from the vibration sensor to adjust at least one the maximum values.

8. The system according to claim 1, wherein the controller adjusts at least one of the maximum values according to a predetermined relationship between the sensed temperatures.

9. The system according to claim 1, further comprising a pressure sensor for supplying a signal indicative of the pressure of gas entering the pumping mechanism, and wherein the controller uses the signal received from the pressure sensor to adjust at least one of the maximum values.

10. The system according to claim 1, wherein the controller comprises a first controller for setting the maximum values, and a second controller for receiving the first and second signals and instructing the first controller to adjust at least one of the maximum values in response thereto.

11. The system according to claim 1, wherein the second temperature sensor is located on an external surface of the stator adjacent to the inlet throat of the stator of the pumping mechanism.

12. A method of controlling a pumping system comprising:

setting maximum values for current and frequency in a motor of the pumping system, wherein the pumping system includes a pumping mechanism, the motor, which is for driving the pumping mechanism, and a variable frequency drive unit for supplying power to the motor;

receiving data indicative of a temperature of gas exhausted from an outlet of the pumping mechanism and a temperature of a stator of the pumping mechanism adjacent to an inlet throat of the stator of the pumping mechanism; and adjusting at least one of the maximum value for current in the motor and the maximum value for rotational frequency in the motor based on a difference between the temperature of the gas exhausted at the outlet of the pumping mechanism and the temperature of the stator adjacent to the inlet throat of the stator of the pumping mechanism, as indicated by the data, during operation of the pumping system.

13. The method according to claim 12, further comprising adjusting the amplitude and frequency of a power supplied to the motor during operation of the pumping system.

14. The method according to claim 13, wherein adjusting the at least one of the maximum values for current in the motor and for rotational frequency in the motor comprises adjusting the at least one of the maximum values in dependence on received signals indicative of the temperature of gas exhausted from the pumping mechanism and the temperature of the stator adjacent to the inlet throat of the stator of the pumping mechanism.

15. The method according to claim 14, wherein adjusting the at least one of the maximum values for the current in the motor and for rotational frequency in the motor comprises adjusting the at least one of the maximum values in dependence on the variation with time of the signal indicative of the temperature of gas exhausted from the pumping mechanism.

16. The method according to claim 14, wherein adjusting the at least one of the maximum values for the current in the motor and for rotational frequency in the motor comprises adjusting the at least one of the maximum values in dependence on at least variation with time of the signal indicative of the temperature of the stator of the pumping mechanism adjacent to the inlet throat of the stator of the pumping mechanism.

17. The method according to claim 12, wherein adjusting the at least one of the maximum values for the current in the motor and for rotational frequency in the motor comprises adjusting the at least one of the maximum values using a signal indicative of vibration of the pumping mechanism during use of the pumping system.

18. The method according to claim 12, wherein adjusting the at least one of the maximum values for the current in the motor and for rotational frequency in the motor comprises adjusting the at least one of the maximum values using a signal indicative of the pressure of gas entering the pumping mechanism.

19. The method according to claim 12, wherein the temperature of the stator is obtained from a sensor located on an external surface of the stator at an inlet throat of the stator of the pumping mechanism.

* * * * *